US012240035B2

(12) United States Patent
Heinrich

(10) Patent No.: US 12,240,035 B2
(45) Date of Patent: Mar. 4, 2025

(54) DIE CASTING MOLD AND METHOD FOR USING AND MAINTAINING A DIE CASTING MOLD

(71) Applicant: Schaufler Tooling GmbH & Co. KG, Laichingen (DE)

(72) Inventor: Siegfried Heinrich, Laichingen (DE)

(73) Assignee: SCHAUFLER TOOLING GMBH & CO. KG, Laichingen (DE)

( * ) Notice: Subject to any disclaimer, the term of this patent is extended or adjusted under 35 U.S.C. 154(b) by 51 days.

(21) Appl. No.: 18/547,906

(22) PCT Filed: Feb. 4, 2022

(86) PCT No.: PCT/EP2022/052726
§ 371 (c)(1),
(2) Date: Aug. 25, 2023

(87) PCT Pub. No.: WO2022/179829
PCT Pub. Date: Sep. 1, 2022

(65) Prior Publication Data

US 2024/0139802 A1 May 2, 2024

(30) Foreign Application Priority Data

Feb. 26, 2021 (DE) ..... 10 2021 104 652.1

(51) Int. Cl.
*B22D 17/22* (2006.01)
*B22D 17/00* (2006.01)
*B22D 17/24* (2006.01)

(52) U.S. Cl.
CPC ..... *B22D 17/22* (2013.01); *B22D 17/002* (2013.01); *B22D 17/229* (2013.01); *B22D 17/24* (2013.01)

(58) Field of Classification Search
CPC ..... B22D 17/22; B22D 17/229; B22D 17/24; B22D 17/26; B22D 17/263
See application file for complete search history.

(56) References Cited

U.S. PATENT DOCUMENTS 5,111,873 A * 5/1992 Kordovski ..... B22D 17/00 164/312
5,163,501 A 11/1992 Tanaka et al.
(Continued)

FOREIGN PATENT DOCUMENTS

CN 205341878 U 6/2016
DE 2341421 B1 9/1974
(Continued)

*Primary Examiner* — Kevin E Yoon
*Assistant Examiner* — Jacky Yuen
(74) *Attorney, Agent, or Firm* — LEYDIG, VOIT & MAYER, LTD.

(57) ABSTRACT

A die casting mold includes a mold frame with at least two mold inserts and with at least one slider, the mold frame comprising a frame pocket for arranging the at least two mold inserts and the at least one slider, the at least two mold inserts delimiting a cavity with an undercut corresponding to the at least one slider, the mold frame comprising a first and a second mold frame halves disposed on opposite sides of a parting plane. At least one of the first and the second mold frame halves is formed by a plurality of mold frame parts connected to one another in a form-fitting manner, one of the plurality of mold frame parts having a locking surface, which, as viewed along a locking axis, is effective as a slider lock against a displacement of the at least one slider directed outwardly as viewed from the cavity.

15 Claims, 5 Drawing Sheets

(56) References Cited

U.S. PATENT DOCUMENTS

| | | | | |
|---|---|---|---|---|
| 8,091,611 | B2 * | 1/2012 | Shibata | B22D 17/24 164/340 |
| 9,713,841 | B2 * | 7/2017 | Chow | B22D 17/22 |
| 10,799,946 | B2 | 10/2020 | Adams et al. | |
| 2018/0207715 | A1 | 7/2018 | Yang et al. | |

FOREIGN PATENT DOCUMENTS

| | | | |
|---|---|---|---|
| DE | 69022863 | T2 | 5/1996 |
| DE | 10231888 | A1 | 1/2004 |
| DE | 102005024767 | B3 | 8/2006 |
| EP | 1970143 | A2 | 9/2008 |
| KR | 101814786 | B1 | 1/2018 |

* cited by examiner

DIE CASTING MOLD AND METHOD FOR USING AND MAINTAINING A DIE CASTING MOLD

CROSS REFERENCE TO RELATED APPLICATIONS

This application is a U.S. National Phase application under 35 U.S.C. § 371 of International Application No. PCT/EP2022/052726, filed on Feb. 4, 2022, and claims benefit to German Patent Application No. DE 10 2021 104 652.1, filed on Feb. 26, 2021. The International Application was published in German on Sep. 1, 2022 as WO 2022/179829 A1 under PCT Article 21(2).

FIELD

The invention relates to a die casting mold with a mold frame, having at least two mold inserts and having at least one slider, the mold frame having a frame pocket for arranging the mold inserts and the at least one slider, the mold inserts delimiting a cavity having an undercut corresponding to the slider, the mold frame having first and second mold frame halves disposed on opposite sides of a parting plane.

BACKGROUND

Die casting molds of the type mentioned above are used in a wide variety of fields of technology, especially in automotive engineering.

SUMMARY

In an embodiment, the present disclosure provides a die casting mold. The die casting comprises a mold frame, with at least two mold inserts and with at least one slider, wherein the mold frame comprises a frame pocket for arranging the at least two mold inserts and the at least one slider, wherein the at least two mold inserts delimit a cavity with an undercut corresponding to the at least one slider, wherein the mold frame comprises a first and a second mold frame halves disposed on opposite sides of a parting plane, and wherein at least one of the first and the second mold frame halves is formed by a plurality of mold frame parts connected to one another in a form-fitting manner, wherein one of the plurality of mold frame parts has a locking surface, which, as viewed along a locking axis, is effective as a slider lock against a displacement of the at least one slider directed outwardly as viewed from the cavity.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
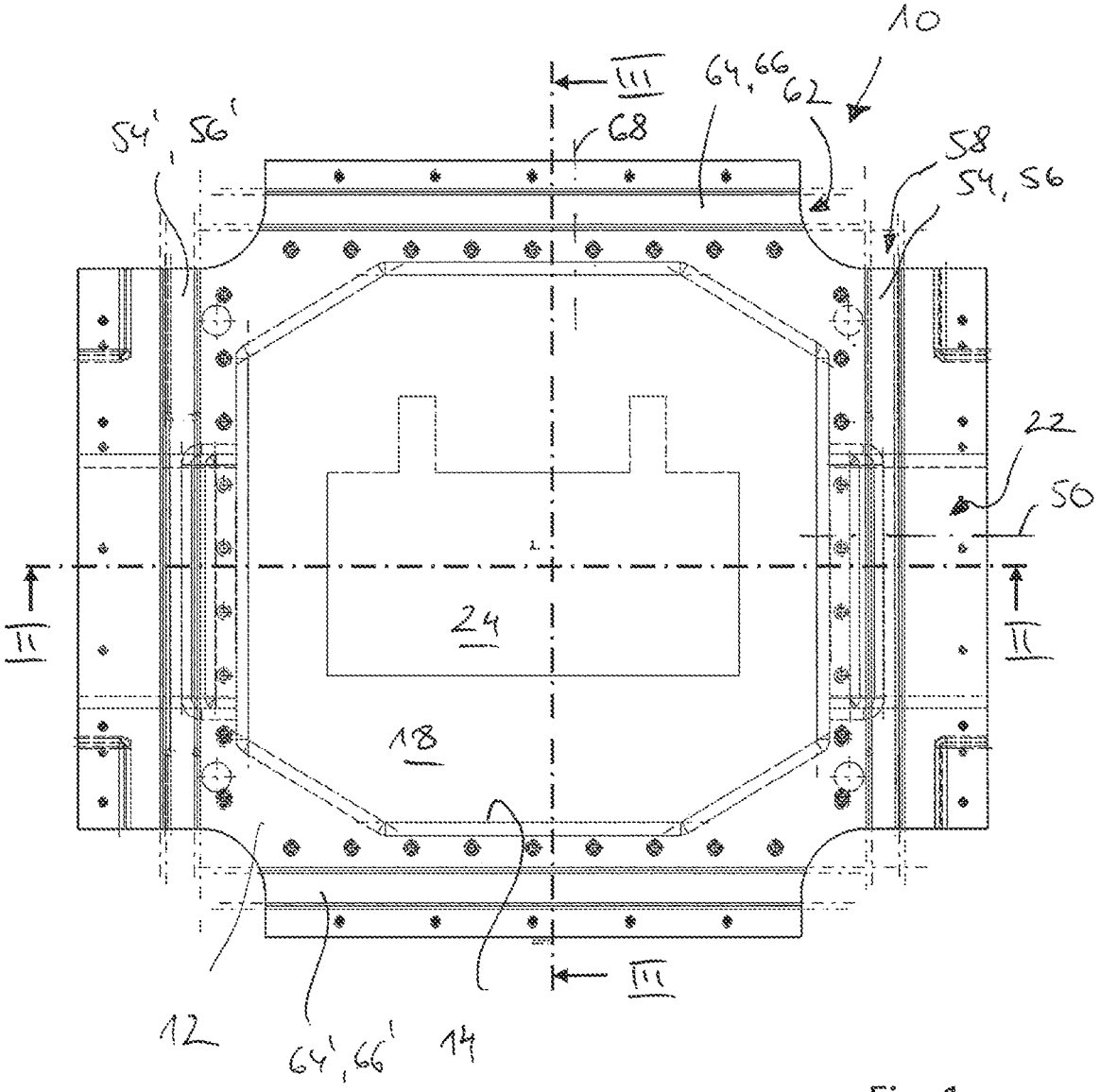
FIG. 1 shows a top view of a first embodiment of a die casting mold.

In accordance with an embodiment, the present disclosure provides a die casting mold, which is also suitable for very large and complex castings and which is as economical as possible to manufacture, operate and repair.

In accordance with another embodiment, the present disclosure provides at least one of the mold frame halves is formed by a plurality of mold frame parts connected to one another in a form-fitting manner, one of the mold frame parts having a locking surface which, viewed along a locking axis, is effective as a slider lock against outward displacement of the slider as viewed from the cavity.

The multi-part construction of at least one mold frame half enables a simplified manufacture of the mold frame of the die casting mold using smaller volumes of raw materials. In addition, simpler and more readily available steel materials can be used for the raw materials—compared with the manufacture of a mold frame half from "one piece". The manufacture of smaller starting volumes, which are mostly machined, is also simpler and less expensive than the manufacture of a very large, one-piece mold frame half.

One of the mold frame parts has a locking surface that acts as a slider lock. In this way, a force of the slider directed outward as viewed from the cavity, can be introduced into the mold frame itself or into one of the mold frame parts. From the mold frame part having the locking surface, the force exerted by the slider can be transmitted to at least one further mold frame part, which is form-fittingly connected to the mold frame part having the locking surface.

The die casting mold according to the invention is also particularly suitable for so-called "mega-molds" or "giga-molds", the mold frames of which (when the mold frame halves are in contact with each other) have a length, width and height of more than two meters each, in particular more than three meters each.

In some embodiments, if the mold frame parts are layered, wherein a first mold frame layer is plate-shaped and provides a bottom portion of a boundary of the frame pocket spaced from the parting plane, and wherein a second mold frame layer is annular, the locking surface being disposed on the second mold frame layer. This enables the manufacture of layered mold frame parts using flatter initial volumes and with smaller machining volumes.

In some embodiments, the first mold frame layer and/or the second mold frame layer is made of one piece. However, it is also possible for the first mold frame layer and/or the second mold frame layer to be composed of a plurality of block-shaped mold frame parts, which in turn are connected to each other in a form-fitting manner.

In some embodiments, if the mold frame parts have support elements in at least one contact region, which interact with each other form-fittingly in the direction parallel to the locking axis. This enables simple and efficient transfer of forces of the slider to the locking surface of a first mold frame part and from there to a further mold frame part form-fittingly connected to it.

Said support elements have a first pair of support surfaces, which prevent outward displacement of a mold frame element relative to the cavity. This allows outwardly directed slider forces to be dissipated into the material of the mold frame parts of the mold frame.

In some embodiments, if the support elements have a second pair of support surfaces, which prevent inward displacement of a mold frame part relative to the cavity. This has the further effect of increasing the stability of the form-fitting connection of the mold frame parts.

In some embodiments, if the mold frame parts have additional support elements in a second contact region, which interact form-fittingly with each other along an additional axis parallel to the parting plane and perpendicular to the locking axis. This enables forces occurring transverse to the locking axis to be absorbed.

In some embodiments, if the support elements and/or the additional support elements are arranged on sides of the cavity facing away from each other, so as to enable the forces arising during pressurization of the cavity to be dissipated symmetrically relative to the cavity.

It is possible for the mold frame parts or at least a subset of the mold frame parts to be block mold parts and to be form-fittingly connected to each other in a connecting region running perpendicular to the parting plane. These block mold parts can extend over the entire height of a mold frame half, or over the height of only one mold frame layer, or over the height of several mold frame layers. Such mold frame layers are also mentioned and described above.

For the form-fitting connection of the block mold parts, in some embodiments, if the connecting region has a toothing profile with undercuts. The form-fitting connection produced in this way between two adjacent mold frame parts is effective within a plane, which runs parallel to the parting plane. Adjacent mold frame parts of the mold frame half or of a layer of the mold frame half can be joined together by joining adjacent mold frame parts together along a joining axis, which is perpendicular to the parting plane (in the manner of assembling a second puzzle piece, which is joined from above to a first puzzle piece disposed in an assembly plane).

In some embodiments, a multi-layer construction is included for the second mold frame half, wherein a first mold frame layer is plate-shaped and provides a bottom portion of a boundary of the frame pocket spaced from the parting plane, and wherein a second mold frame layer is segment-shaped, in particular C-shaped. In some embodiments, such C-shaped second mold frame layer together with the slider forms a circumferentially closed boundary section of the cavity.

Also the mold frame parts of the second mold frame half or at least a subset of the mold frame parts of the second mold frame half can be designed as block mold parts and can be form-fittingly connected to each other in a connecting region running perpendicular to the parting plane, also in the case where the block mold frame parts ("block mold parts") extend over the entire height of the second mold frame half or else over one or more mold frame layers of the second mold frame half.

The invention also relates to a method for using and maintaining a die casting mold, in particular a die casting mold described above, wherein mold inserts of the die casting mold are exchanged for new mold inserts after a first phase of use while retaining a mold frame, wherein further optional exchanges of only the mold inserts take place.

In accordance with another embodiment, the present disclosure provides that after a predetermined number of mold insert exchanges—a first subset of mold frame parts of at least one mold frame half is retained, and in that only a second subset of mold frame parts of the at least one mold frame half is exchanged for new mold frame parts.

It is known from the prior art to use mold inserts during an initial use phase up to a wear limit. For example, initial mold inserts can be used hundreds of thousands of times and then, while retaining the mold frame, can be replaced with new mold inserts, which in turn can be used, for example, hundreds of thousands of times. After a single or double or even triple exchange of the mold inserts, the entire mold frame is no longer, as is usual in the prior art, exchanged. Instead, a first subset of mold frame parts of at least one mold frame half is retained, and only a second subset of mold frame parts of the at least one mold frame half is exchanged for new mold frame parts.

The mold frame parts to be replaced are those mold frame parts that are exposed to a higher load. In particular, this involves a mold frame part that has a locking surface for a slider of the die casting mold, which corresponds to an undercut of a cavity of the mold frame inserts. This enables a particularly economical manufacture, use and maintenance of a die casting mold.

Further features and advantages of the invention are subject of the following description and the graphic representation of embodiments.

In the drawing, an embodiment of a die casting mold as a whole is designated by the reference numeral 10. This mold has a mold frame 12, which has a frame pocket 14 for arranging mold inserts 18, 20, compare also FIGS. 2 and 3, and a slider 22.

The mold inserts 18, 20 define a cavity 24 having a parting plane 26. The cavity 24 is also defined by a slider head 28 disposed on a slider body 30 of the slider 22.

The slider 22 corresponds to an undercut 32 of the cavity 24, which prevents simple demolding of a die casting mold from the cavity 24 by merely spacing the mold inserts 18 and 20 apart. Much more, demolding of a die casting mold from the cavity 24 may require that the slider 22 first be displaced outwardly relative to the cavity 24, in order to expose the undercut 32.

However, during filling and pressurization of the cavity 24 with die casting material, the slider 22 remains in its position filling the undercut 32. For this purpose, the slider 22 has a pressing surface 34 facing away from the cavity 24, the pressing surface engaging with a locking surface 36 of the mold frame 12.

The mold frame 12 has two mold frame halves 38 and 40 disposed on opposite sides of the parting plane 26. A first mold frame half 38 serves to dispose the first mold insert 18; a second mold frame half 40 serves to dispose the second mold insert 20.

The mold frame halves 38, 40 have a multi-part construction. The mold frame half 38 includes a first, particularly one-piece, mold frame layer 42 that is plate-shaped and provides a bottom portion 44 of a boundary of the frame pocket 14 spaced from the parting plane 26. A second, particularly one-piece mold frame layer 46 extends annularly around the mold insert 18, wherein a portion of an inner surface of the annular mold frame layer 46 facing the cavity 24 is formed by the locking surface 36.

The pressing surface 34 of the slider 22 and the locking surface 36 of the second mold frame layer 46 are complementary to each other and extend in particular in a plane 48, which is disposed at an angle with regard to the parting plane 26, so that, in the course of the demolding of the cavity 24, the locking surface 36 is detachable from the pressing surface 34 by moving the mold frame half 38 together with the mold insert 18 in a direction perpendicular to the parting plane 26 relative to the parting plane 26 (this movement can of course be accompanied also by a movement of only the second mold frame half 40). The inclination of the plane 48 further allows a force exerted by the slider 22 on the locking surface 36 via the pressing surface 34 to be transmitted to the second mold frame layer 46 along a locking axis 50. The locking axis 50 is parallel to the parting plane 26.

The mold frame layers 42 and 46 each have integrally molded support elements 54 and 56 that provide a form-fit locking between the mold frame layers 42 and 46 in at least one contact region 52.

The support elements 54 and 56 are formed complementarily to each other, for example, in the form of a shoulder and a shoulder receptacle. A first pair of support surfaces 58 prevents displacement of the second mold frame layer 46 outwardly relative to the cavity 24 by being supported against the first mold frame layer 42. A second pair of support surfaces 60 prevents displacement of the first mold frame layer 42 outwardly relative to the cavity 24 and/or displacement of the second mold frame layer 46 inwardly relative to the cavity 24, respectively.

The form-fit locking of the support elements 54, 56 is effective in a direction parallel to the locking axis 50.

Figure 2:
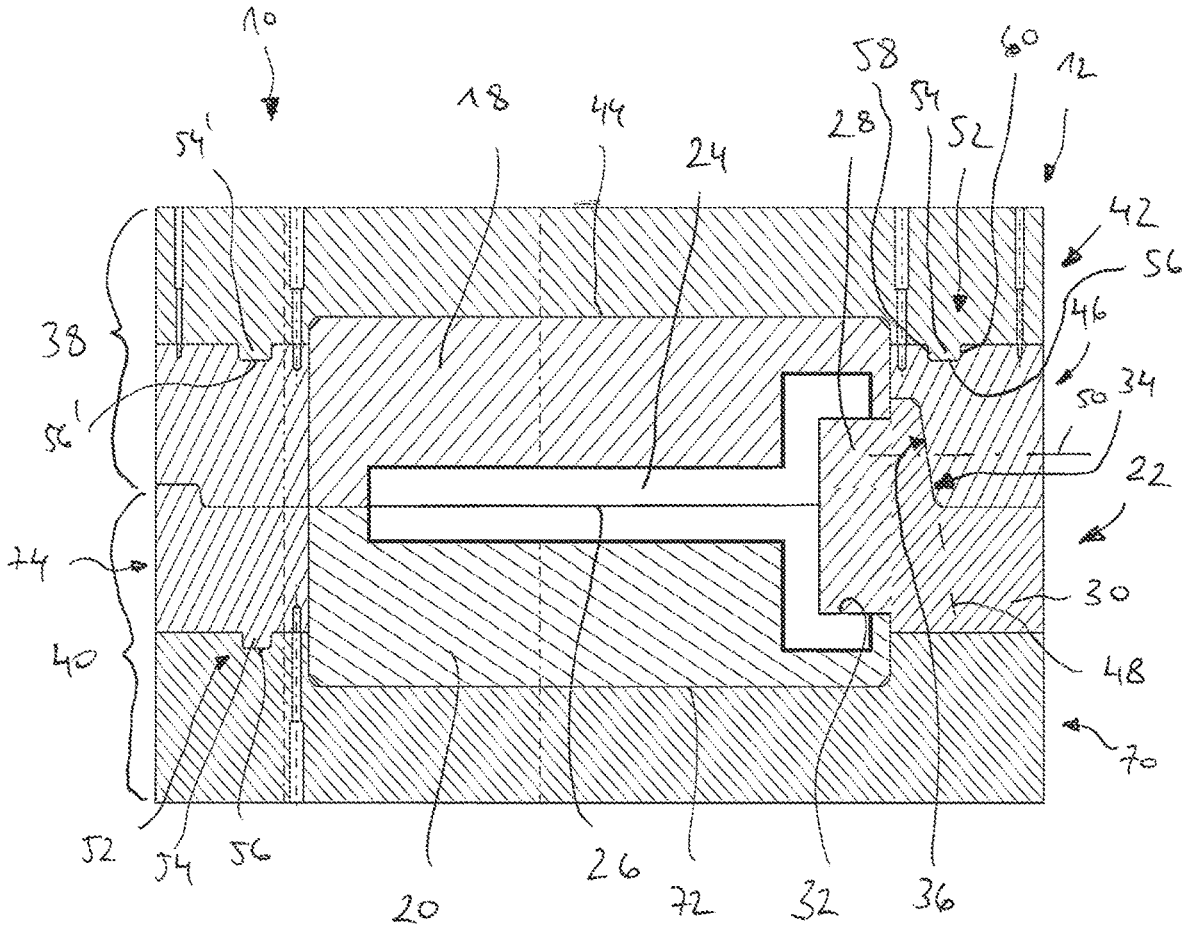
FIG. 2 shows a sectional view of the die casting mold according to FIG. 1, along a sectional plane designated II-II in FIG. 1.
Figure 3:
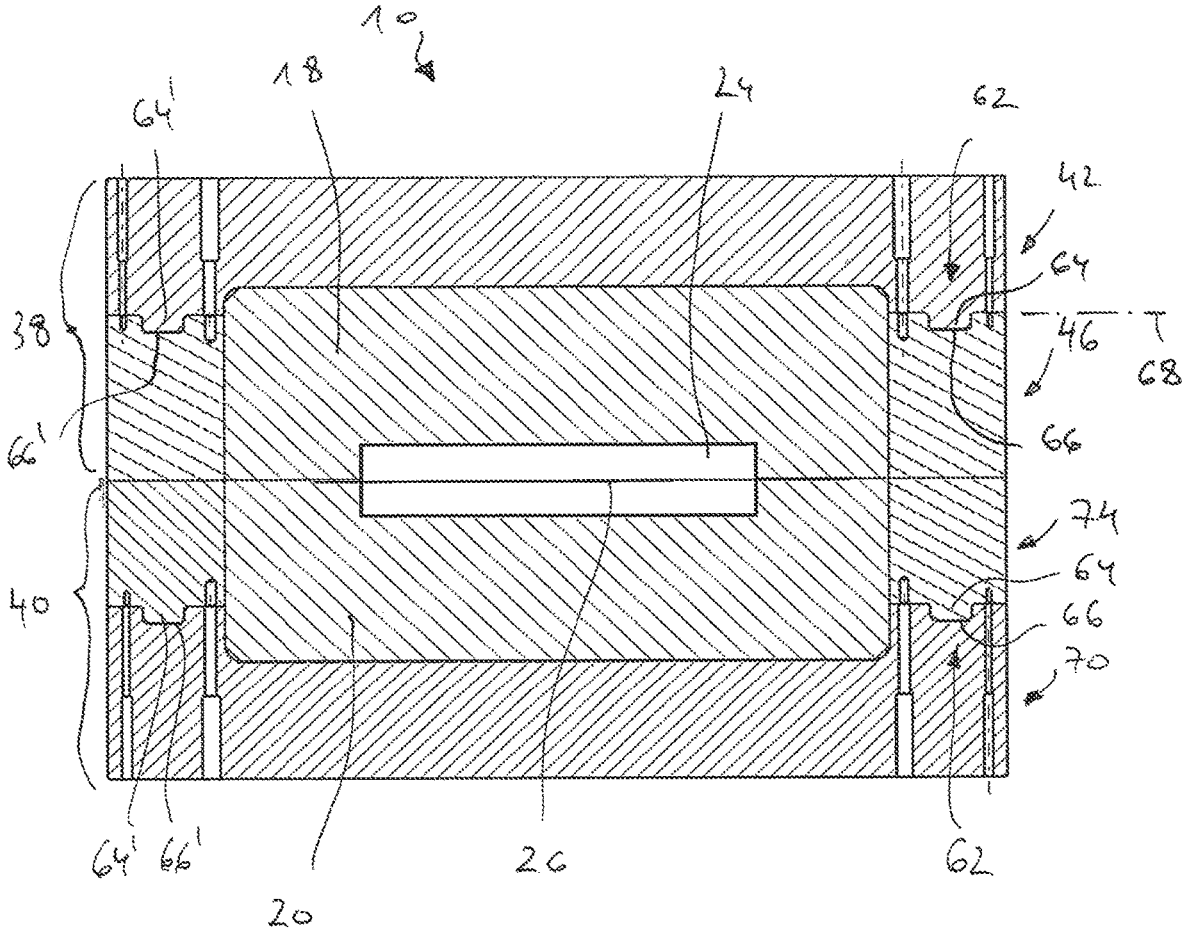
FIG. 3 shows a sectional view of the die casting mold according to FIG. 1, along a sectional plane designated III-III in FIG. 1.

FIG. 3 shows the die casting mold 10 in a section rotated by 90° in relation to FIG. 2. In a second contact region 62 offset by 90° relative to the first contact region 58, the die casting mold 10 has additional support elements 64, 66, which, viewed along an additional axis 68, are form-fittingly engaged with each other. The additional axis 68 runs parallel to the parting plane 26 and perpendicular to the locking axis 50, compare also FIG. 1.

The support elements 54, 56 and the additional support elements 64, 66 are each arranged on both sides of the cavity 24 relative to the cavity 24, which is illustrated in FIGS. 1 and 2 by the reference numerals 54' and 56', and in FIGS. 1 and 3 by the reference numerals 64' and 66'.

In some embodiments, the mold frame parts of the second mold frame half 40 are also layered, with a one-piece first mold frame layer 70, which is plate-shaped and provides a bottom portion 72 of a boundary of the frame pocket 14 spaced from the parting plane 26, and with a one-piece second mold frame layer 74, which is open in its circumferential extension to allow an arrangement of the slider 22.

Also the mold frame layers 70 and 74 of the second mold frame half 40 have support elements 54, 56 disposed in a contact region 52 and engaging each other in a form-fitting manner, the form-fit locking being effective in a direction parallel to the locking axis 50.

In a corresponding manner, additional support elements 64, 66, which are form-fittingly effective parallel to the additional axis 68, are disposed in an additional contact region 62, compare FIG. 3.

Figure 4:
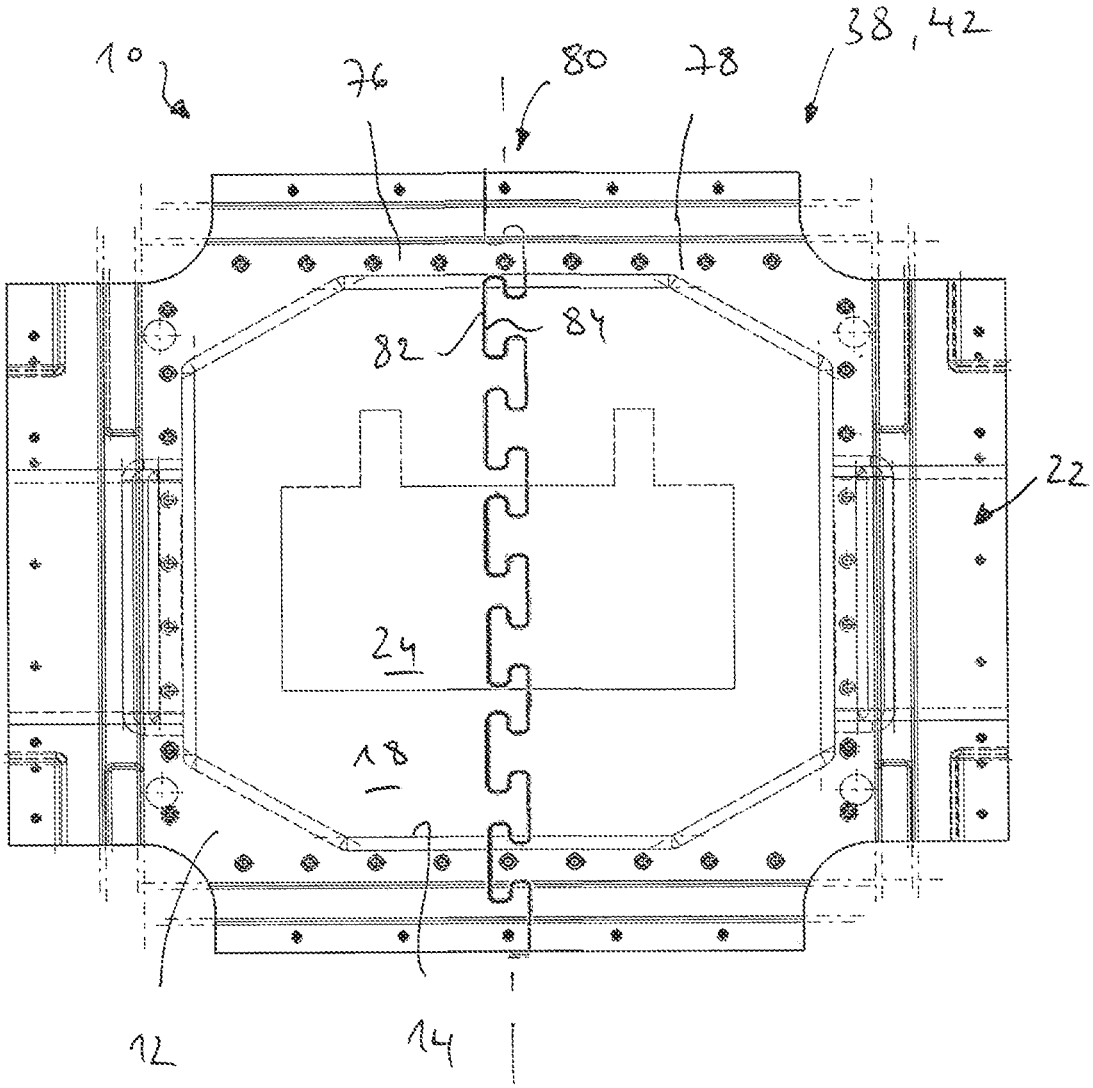
FIG. 4 shows a top view of a further embodiment of a die casting mold.
Figure 5:
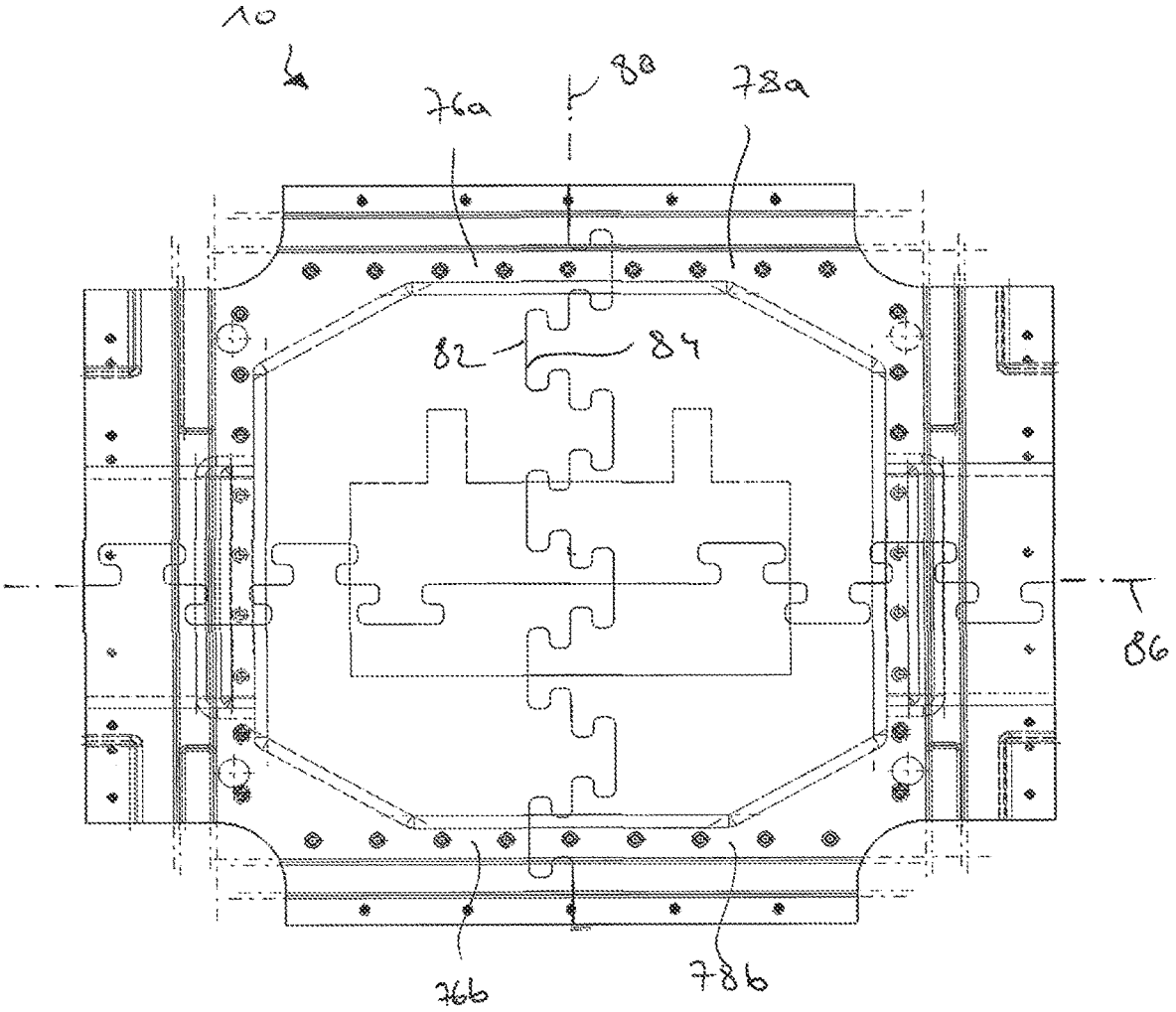
FIG. 5 shows a top view of a further embodiment of a die casting mold.

For the description of the embodiment according to FIGS. 4 and 5, reference is made to the above description. Only the special features of the embodiments according to FIGS. 4 and 5 are discussed below.

The mold frame half 38 of the die casting mold 10 according to FIG. 4 has two block-shaped mold frame parts (referred to here as block mold parts 76 and 78), which are form-fittingly connected to each other in a connecting region 80 extending perpendicular to the parting plane 26. In particular, the block mold parts 76 and 78 have mutually facing and mutually complementary boundary surfaces with toothed profiles 82, 84, the mutual undercuts of which bring about a form-fit locking of the block mold parts 76 and 78 effective parallel to the parting plane 26.

The block mold parts 76 and 80 may extend over the entire height of the mold frame half 38 or, in the case where the mold frame half 38 has layered mold frame parts, over only one layer of the mold frame half 38, in particular over the height of only the first mold frame layer 42 according to embodiments of FIGS. 1 to 3.

Additionally or alternatively, it is possible for the second mold frame half 40 of the die casting mold 10 shown in FIG. 4 to have mold frame parts corresponding to the block mold parts 76 and 78 of the first mold frame half 38.

FIG. 5 shows a die casting mold 10, the structure of which corresponds essentially to the die casting mold 10 shown in FIG. 4, but which has a further connecting region 86. This region also extends perpendicularly to the parting plane 26 of the die casting mold 10 and also perpendicularly to the first connecting region 80. This makes it possible to divide a mold frame half 38, 40 into at least four block mold parts 76*a*, 76*b*, 78*a*, 78*b*, which are form-fittingly connected to one another ("puzzle-like").

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A die casting mold, comprising:

a mold frame, with at least two mold inserts and with at least one slider, wherein the mold frame comprises a frame pocket for arranging the at least two mold inserts and the at least one slider, wherein the at least two mold inserts delimit a cavity with an undercut corresponding to the at least one slider, wherein the mold frame comprises a first and a second mold frame halves disposed on opposite sides of a parting plane, wherein at least one of the first and the second mold frame halves is formed by a plurality of mold frame parts connected to one another in a form-fitting manner, wherein one of the plurality of mold frame parts has a locking surface, which, as viewed along a locking axis, is effective as a slider lock against a displacement of the at least one slider directed outwardly as viewed from the cavity, wherein the plurality of mold frame parts are layered, wherein a first mold frame layer is plate-shaped and provides a bottom portion of a boundary of the frame pocket spaced from the parting plane, and wherein a second mold frame layer is annular, the locking surface being disposed on the second mold frame layer, wherein the second mold frame layer comprises a ring shaped inner surface facing the cavity, and wherein the ring shaped inner surface comprises the locking surface.

2. The die casting mold according to claim 1, wherein the plurality of mold frame parts have support elements in at least one contact region, wherein the support elements interact with each other in a form-fitting manner in a direction parallel to the locking axis.

3. The die casting mold according to claim 2, wherein the support elements include a first pair of support surfaces, which prevent outward displacement of a mold frame part of the plurality of mold frame parts relative to the cavity.

4. The die casting mold according to claim 2, wherein the support elements include a second pair of support surfaces, which prevent inward displacement of a mold frame part of the plurality of mold frame parts relative to the cavity.

5. The die casting mold according to claim 2, wherein the plurality of mold frame parts have, in a second contact region, additional support elements, which interact with each other in a form-fitting manner along an additional axis parallel to the parting plane and perpendicular to the locking axis.

6. The die casting mold according to claim 5, wherein the support elements and/or the additional support elements are disposed on sides of the cavity facing away from each other.

7. The die casting mold according to claim 1, wherein the plurality of mold frame parts or at least a subset of the plurality of mold frame parts are block mold parts and are form-fittingly connected to each other in a connecting region running perpendicular to the parting plane.

8. The die casting mold according to claim 7, wherein the connecting region has a toothed profile with undercuts.

9. The die casting mold according to claim 1, wherein mold frame parts of the second mold frame half are layered, wherein a first mold frame layer is plate-shaped and provides a bottom portion of a boundary of the frame pocket spaced from the parting plane, and wherein a second mold frame layer is segment-shaped.

10. The die casting mold according to claim 1, wherein mold frame parts of the second mold frame half or at least a subset of the mold frame parts of the second mold frame half are block mold parts and are connected to each other in a connecting region running perpendicular to the parting plane.

11. The die casting mold according to claim 1, wherein mold frame parts of the second mold frame half are layered, wherein a first mold frame layer is plate-shaped and provides a bottom portion of a boundary of the frame pocket spaced from the parting plane, and wherein a second mold frame layer is C-shaped.

12. The die casting mold according to claim 1, wherein the mold frame is at least two meters in width and at least two meters in length.

13. The die casting mold according to claim 12, wherein the width and length of the mold frame extend in a plane parallel to the parting plane of the mold.

14. A method for using and maintaining the die casting mold according to claim 1, wherein the at least two mold inserts of the die casting mold are exchanged for new mold inserts after a first use phase while retaining the mold frame, wherein further exchanges of the at least two mold inserts are carried out—and wherein after a predetermined number of exchanges of the at least two mold inserts a first subset of the plurality of mold frame parts of at least one mold frame half is retained, and a second subset of mold frame parts of the at least one mold frame half is exchanged for new mold frame parts.

15. The method according to claim 14, wherein the second subset comprises a mold frame part having a locking surface for a slider of the die casting mold corresponding to the undercut of the cavity of the at least two mold inserts.

* * * * *